United States Patent [19]

Jose

[11] Patent Number: 4,840,132

[45] Date of Patent: Jun. 20, 1989

[54] ROTARY COMBUSTOR

[75] Inventor: Vince A. Jose, Brea, Calif.

[73] Assignee: Westinghouse Electric Corp., Pittsburgh, Pa.

[21] Appl. No.: 222,592

[22] Filed: Jul. 21, 1988

[51] Int. Cl.[4] ..... A47J 36/00

[52] U.S. Cl. ..... 110/246; 110/234; 122/6 A; 432/116

[58] Field of Search ..... 110/233, 234, 235, 246, 110/255, 257, 258, 259, 182.5; 122/6.6, 6 A, 235 R, 235 A, 235 B, 235 E, 235 HH, 235 K, 235 T; 432/103, 105, 106, 116

[56] References Cited

U.S. PATENT DOCUMENTS

| | | | |
|---|---|---|---|
| 1,319,700 | 10/1919 | Gould | 432/72 |
| 2,469,078 | 5/1945 | Robison | 277/148 |
| 3,822,651 | 7/1974 | Harris et al. | 110/246 |
| 3,875,904 | 4/1975 | Astrom | 122/235 B |
| 4,066,024 | 1/1978 | O'Connor | 110/246 |
| 4,226,584 | 10/1980 | Ishikawa | 432/77 |
| 4,437,418 | 3/1984 | Guillaume et al. | 110/246 |
| 4,615,283 | 10/1986 | Ciliberti et al. | 110/216 |
| 4,735,157 | 4/1988 | Jurusz | 110/246 |

*Primary Examiner*—Edward G. Favors

[57] ABSTRACT

A rotary combustor which includes a plurality of water cooled tubes secured together directly to each other to form a cylindrical barrel defining a combustion chamber therein. Every other length of tube is bent outwardly at spaced locations along its length to form a plurality of openings in the barrel to allow combustion air into the combustion chamber. Means including a smaller ring header and a larger ring header are provided at each end of the barrel to interconnect the tubes to permit the circulation of water therethrough.

6 Claims, 4 Drawing Sheets

ROTARY COMBUSTOR

BACKGROUND OF THE INVENTION

1. Field of the Invention

The present invention is directed to a rotary combustor useful in a waste disposal system for the combustion of solid waste materials and, more particularly, to an improved rotary combustor having water cooled tool tubes, some of which are bent outwardly to form openings for combustion air into the combustor.

2. Description of the Related Art

Waste disposal systems employing rotary combustors for the combustion of waste materials have long been known. For example, numerous types of waste disposal combustion systems for solid waste materials have been employed for the disposal of municipal waste. Useful types of such waste disposal systems are described in U.S. Pat. Nos. 3,822,651, 4,066,024 and 4,615,283. These types of waste disposal combustion systems utilize a rotary combustor formed by a plurality of longitudinally extending pipes secured together to form a cylindrical barrel defining a combustion chamber therein. The pipes are connected together by webs having openings therein for the entry of combustion air into the combustion chamber. The pipes are adapted to accommodate the flow of water therethrough to cool the walls of the combustor and produce steam. Air is charged to the combustor through various means and combustion gases from the unit passed to a boiler or furnace for further production of steam. Ash from the combustion material falls out of the outlet end of the combustor into an ash receiving chamber. These types of waste disposal combustion systems have been found very useful in waste disposal while providing revenue through generation of steam and electric power.

While such systems employing rotary combustors have proven useful in processing solid waste materials such as municipal waste, the need still exists for a rotary combustor useful in a waste disposal system which is highly efficient in the generation of steam and which is yet economical in operation and construction.

SUMMARY OF THE INVENTION

It is an object of the present invention to provide a rotary combustor for a waste disposal system which increases the amount of steam generated and which is economical in construction.

It is a further object of the present invention to provide a rotary combustor for a waste disposal system which includes a plurality of bent water cooled tubes having outward bends therein to form a plurality of openings for combustion air into the combustor.

It is another object of the present invention to provide a rotary combustor for a waste disposal system having a plurality of tubes secured directly to each other to form a cylindrical barrel and being provided on each end with a pair of headers for circulating water through the tubes.

The invention achieves the above objects by providing a rotary combustor which includes a plurality of water cooled tubes secured together to form a cylindrical barrel defining a combustion chamber therein and which has a charge end and a discharge end. The tubes are directly secured to each other without any webs in between. Means are provided for interconnecting the tubes for circulating water therethrough. Preferably these means comprise a pair of ring headers at each end of the barrel. Certain of the tubes are bent outwardly at spaced locations along their lengths to form a plurality of openings in the barrel to allow combustion air into the combustion chamber. Each pair of ring headers includes a smaller ring header and a larger ring header with some of the tubes being connected between the smaller ring headers and the remainder of the tubes being connected between the larger ring headers.

These, together with other objects and advantages, which will be subsequently apparent, reside in the details of the construction and operation of the invention as more fully described and claimed hereafter, reference being made to the accompanying drawings forming a part hereof where like numerals refer to like parts throughout.

DESCRIPTION OF THE PREFERRED EMBODIMENT

Figure 1:
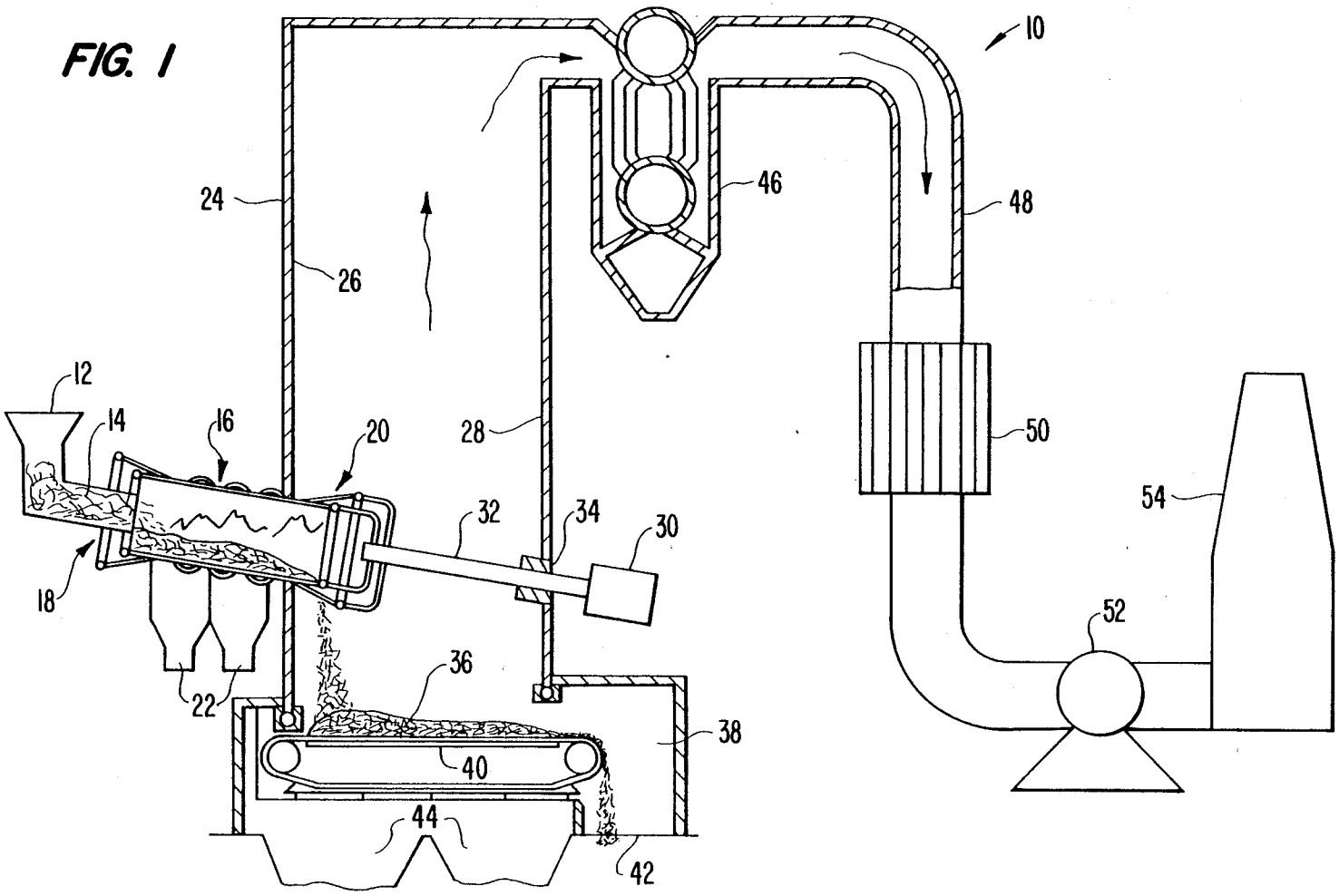
FIG. 1 is a schematic cross-sectional view of a waste disposal system employing a rotary combustor according to the present invention.

Referring to the drawings, shown in FIG. 1 is a waste disposal system 10 for the combustion of waste materials according to the present invention. The system is useful in the combustion of solid fuel such as municipal waste.

The waste disposal system 10 includes a hopper 12 for receiving waste material 14 and feeding it to a rotary combustor 16 according to the present invention wherein the waste material is incinerated inside of the combustor. The rotary combustor 16 has a charge end 18 and a discharge end 20. Air for combustion is supplied through windboxes 22 associated with the combustor. The discharge end 20 of the combustor 16 is enclosed within a water wall furnace 24 having a front wall 26 and a back wall 28. A rotary joint 30 is provided that serves to feed water through a coaxial pipe or tube 32 to the rotary combustor, and return a combination of hot water and steam for heat recovery, with a rotary seal 34 surrounding the pipe 32 in the back wall 28 of the furnace.

As the waste material 14 passes through the combustor 16, waste material is burned with the resulting ash 36 and other residue that is formed flowing from the discharge end 20 of the combustor into the lower end of the furnace 24 wherein it falls by gravity to an ash receiving chamber 38 having suitable conveying means 40 which conveys the ash and other residue to an ash discharge outlet 42. The conveying means 40 may be any suitable conveyor apparatus such as a traveling grate conveyor or a vibrating conveyor. Sifting hoppers 44 may be provided underneath the conveying means 40 to collect any material which falls through the conveying means.

The hot gases from the combustor 16 are discharged into the furnace 26 where they rise as shown by the arrows in FIG. 1, and are used to produce steam in a boiler bank 46 whereby the steam may be used as an appropriate energy source. The gases thereupon are passed through a conduit 48 to a feed water economizer 50 which removes additional heat from the gases after the gases have left the boiler bank. From the economizer, the gases then pass through the conduit 48 to an induction fan 52 and to a flue 54 for discharge to the atmosphere.

Figure 2:
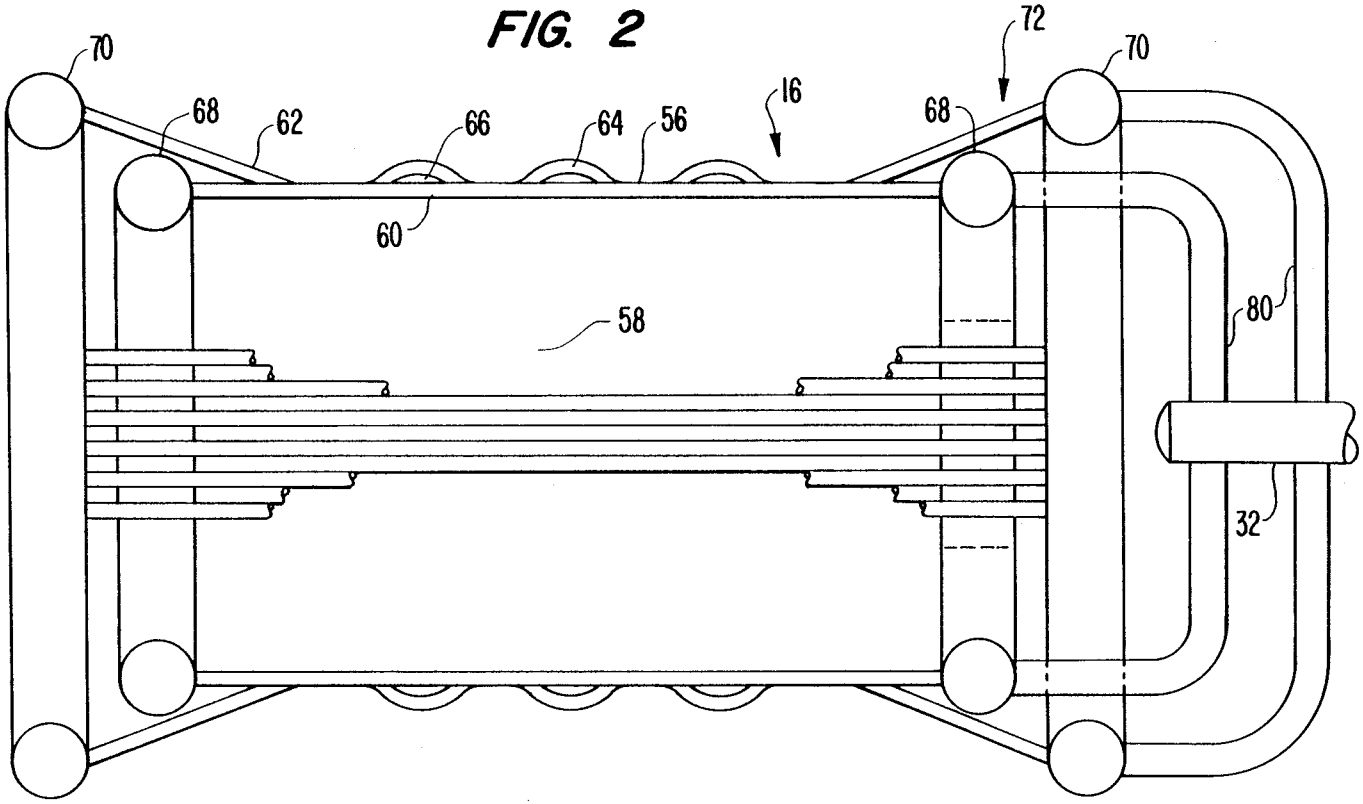
FIG. 2 is a partial enlarged side view of a rotary combustor according to the present invention illustrating a pair of ring headers on each end of the combustor and bent tubes forming openings into the combustor for combustion air.
Figure 3:
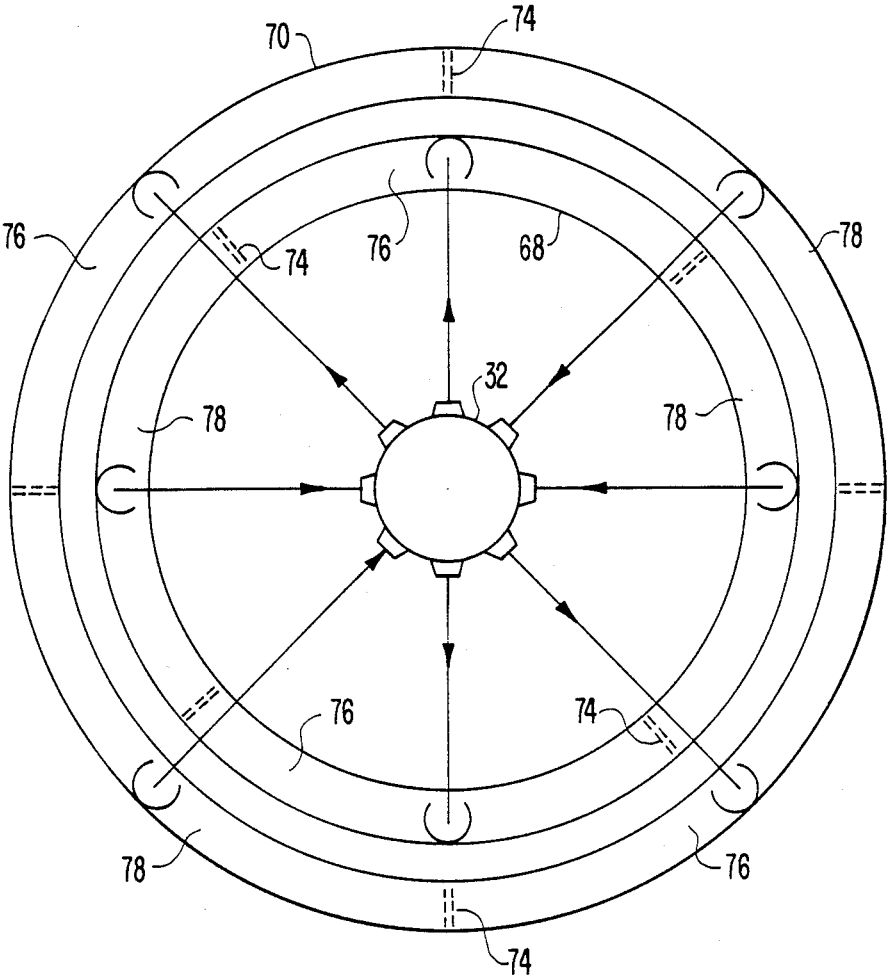
FIG. 3 is an end view of the discharge end of the rotary combustor illustrating the circulation of water through ring headers at the discharge end.
Figure 4:
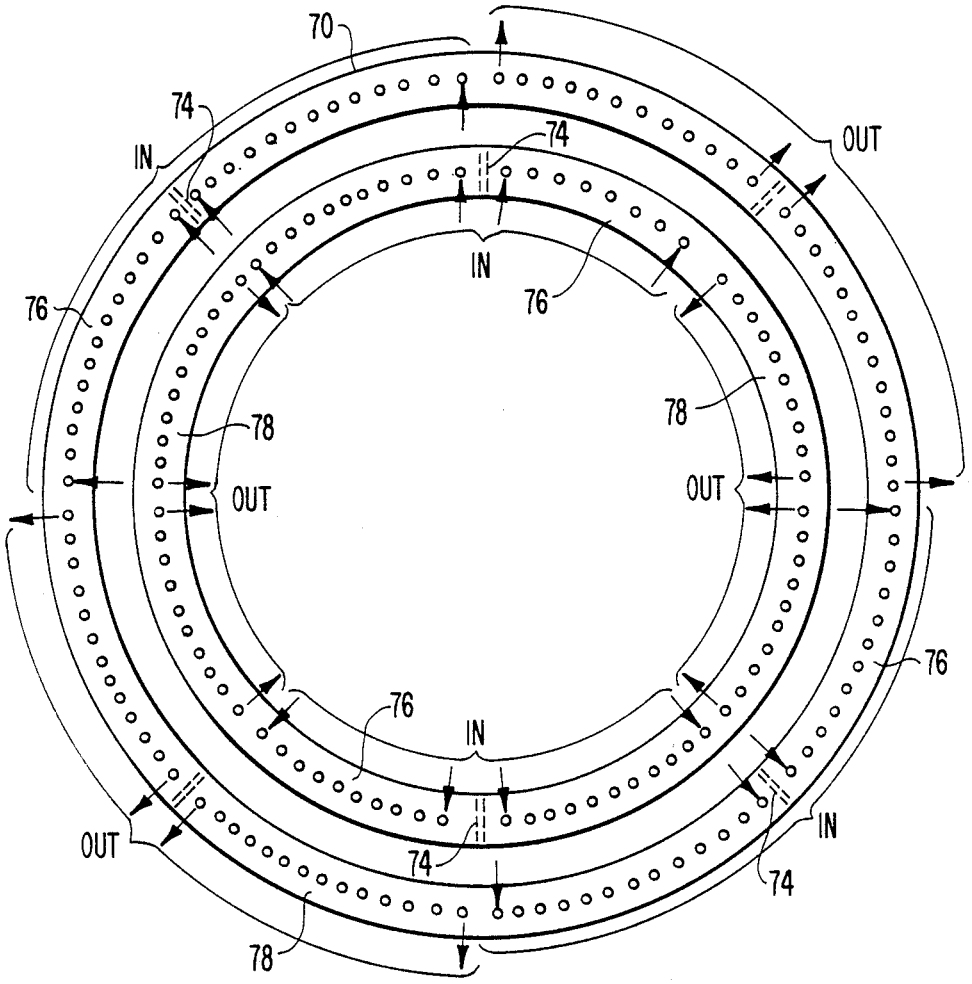
FIG. 4 is an end view of the charge end of the combustor illustrating circulation of water through ring headers at the charge end.

As shown in detail in FIGS. 2, 3 and 4, the rotary combustor 16 is comprised of a plurality of water cooled tubes secured together to form a cylindrical barrel 56 defining a combustion chamber 58 therein. The water cooled tubes are comprised of a plurality of alternating straight tubes 60 and bent tubes 62 secured directly to each other in abutting relationship to form the cylindrical barrel 56. The bent tubes 62 have a plurality of bends 64 which are bent outwardly from the center of the barrel at spaced locations along the lengths of the tubes to form a plurality of openings 66 into the barrel 56 to allow combustion air into the combustion chamber 58.

Each end of the barrel 56 is provided with a smaller ring header 68 and a larger ring header 70 which constitute means 72 for interconnecting the tubes for circulating water therethrough. The straight tubes 60 and the bent tubes 62 are alternately connected to the smaller ring header 68 and the larger ring header 70 at each end of the barrel 56. While all of the straight tubes 60 may either be connected to the smaller ring header 68 or the larger ring header 70 and conversely all of the bent tubes 62 may either be connected to the smaller ring header 68 or the larger ring header 70, in the embodiment shown in FIGS. 2, 3 and 4, the straight tubes 60 are all connected to the smaller ring header 68 and the bent tubes 62 are all connected to the larger ring header 70.

Each of the ring headers is provided with a plurality of baffles 74 therein to divide the interior of the headers into feed water inlet sections 76 and water outlet sections 78 to accommodate the flow of water from the discharge end 20 to the charge end 18 of the barrel through certain of the tubes and back from the charge end 18 to the discharge end 20 of the barrel 56 through other tubes. FIG. 3 illustrates the inlet and outlet flow of water at the discharge end 20 of the barrel 56 while FIG. 4 illustrates the inlet and outlet flow of water at the charge end 18 of the barrel 56. The arrows in each figure indicate the direction of flow. Water is supplied to and returned from the headers to and from coaxial pipe 32 by pipes 80 as shown in FIG. 2.

The rotary combustor 16 of the present invention provides an improvement over the type of rotary combustor shown, for example, in U.S. Pat. No. 3,822,651 in that it eliminates the necessity of webs having air openings therein being welded between the tubes to secure the tubes together to form a barrel. With the present invention, the tubes are directly secured to each other. In the type of rotary combustor shown in U.S. Pat. No. 3,822,651, the webs tend to erode during use and must be replaced. By securing the pipes directly to each other, it also cuts down the length of welds which are normally required to hold the combustor together. In the present invention the length of welds is cut down to one-half of what is required in the aforementioned prior art combustors. This also cuts down the number of man hours necessary to construct the barrel. Moreover, by having every other length of tube being bent to form openings for air, the necessity of drilling holes or openings in each web along its entire length is eliminated. It is more economical to form certain of the tubes with bends therein to create the air openings than it is to drill each opening.

By eliminating the webs between the tubes, the number of tubes forming the barrel is thereby increased to twice as much as that of the prior art rotary combustors previously mentioned. When the webs are eliminated, the tubes that replace them reclaim all the heat lost due to the gaps created by the webs. This increases the amount of steam, and consequently power, generated by approximately 50%. The use of a smaller ring header and a larger ring header at each end of the barrel is also a significant advantage of the present invention. The use of the four headers provides a wide range of flexibility in adjusting to the different design parameters of specific projects and also permits the use of smaller headers when the size of the combustor increases. In addition, because of the increase of power generated by the rotary combustor of the present invention, the size of the combustor can be reduced to a minimum compared to the size of the combustor of the aforementioned prior art rotary combustor required to produce the same output.

In summary, the present invention increases the power output, reduces the overall costs and eliminates potential problems in the web area of a rotary combustor.

Numerous alterations and modifications of the structure herein disclosed will suggest themselves to those skilled in the art. It is to be understood, however, that the present disclosure relates to the preferred embodiments of the invention which is for the purposes of illustration only and is not to be construed as a limitation of the invention. Also, such modifications which do not depart from the spirit of the invention are intended to be included within the scope of the appended claims.

I claim:

1. A rotary combustor comprising:

a plurality of water cooled tubes secured directly to each other in abutting relationship to form a cylindrical barrel defining a combustion chamber therein, said barrel having a charge end and a discharge end;

means interconnecting said tubes for circulating water therethrough; and wherein at least certain of said tubes are bent outwardly from the center of said barrel at spaced locations along their lengths to form a plurality fo openings in said barrel to allow combustion air into said combution chamber.

2. A rotary combustor as defined in claim 1, wherein every other tube is bent outwardly along its length to form said openings.

3. A rotary combustor as defined in claim 1, wherein said means interconnecting said tubes include a pair of ring headers at each end of said barrel.

4. A rotary combustor comprising:

a plurality of water cooled tubes secured together to form a cylindrical barrel defining a combustion chamber therein, said barrel having a charge end and and a discharge end;

means interconnecting said tubes for circulating water therethrough comprising a pair of ring headers at each end of said barrel;

each said pair of ring headers including a smaller ring header and a larger ring header with some of said tubes being connected between said smaller ring headers and the remainder of said tubes being connected between said larger ring headers; and wherein at least certain of said tubes are bent outwardly at spaced locations along their lengths to form a plurality of openings in said barrel to allow combustion air into said combustion chamber.

5. A rotary combustor as defined in claim 4, wherein said tubes are connected between said smaller ring headers and said larger ring headers in alternating fashion.

6. A rotary combustor as defined in claim 4, wherein each of said ring headers is provided with internal baffles to divide each said header into feed water inlet sections and water outlet sections.

* * * * *